US007535177B2

(12) United States Patent
Kim et al.

(10) Patent No.: US 7,535,177 B2
(45) **Date of Patent: *May 19, 2009**

(54) PLASMA DISPLAY PANEL HAVING ELECTRODES ARRANGED WITHIN BARRIER RIBS

(75) Inventors: Woo-Tae Kim, Suwon-si (KR); Kyoung-Doo Kang, Suwon-si (KR); Se-Jong Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 325 days.

This patent is subject to a terminal disclaimer.

(21) Appl. No.: 11/107,867

(22) Filed: Apr. 18, 2005

(65) Prior Publication Data

US 2005/0242724 A1 Nov. 3, 2005

(30) Foreign Application Priority Data

Apr. 28, 2004 (KR) ..... 10-2004-0029649

(51) Int. Cl.
*H01J 17/49* (2006.01)
*H01J 17/16* (2006.01)
*H01J 11/00* (2006.01)

(52) U.S. Cl. ..... 313/586; 313/582; 313/583; 315/169.1

(58) Field of Classification Search ..... 313/582–587, 313/292, 238

See application file for complete search history.

(56) References Cited

U.S. PATENT DOCUMENTS 5,004,950 A 4/1991 Lee (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Sikha Roy
*Assistant Examiner*—Tracie Y Green
(74) *Attorney, Agent, or Firm*—Robert E. Bushnell, Esq.

(57) ABSTRACT

A plasma display panel having a plurality of pixels, each pixel having at least three sub-pixels, each sub-pixel containing at least two discharge cells. The plasma display panel includes a transparent front panel, a back panel positioned to be separate from and parallel to the front panel, first barrier ribs located between the front panel and the back panel and defining discharge cells together with the front panel and the back panel, the first barrier ribs being made out of a dielectric material, front discharge electrodes located within the first barrier ribs and surrounding the discharge cells, back discharge electrodes also located within the first barrier ribs and also surrounding the discharge cells and being separated from the front discharge electrodes, phosphor layers located within the discharge cells, respectively, and a discharge gas present within the discharge cells.

19 Claims, 9 Drawing Sheets

U.S. PATENT DOCUMENTS

| | | | | |
|---|---|---|---|---|
| 5,229,685 | A * | 7/1993 | Kim et al. | 313/484 |
| 5,396,149 | A * | 3/1995 | Kwon | 313/486 |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A * | 10/1997 | Shinoda et al. | 427/68 |
| 5,701,056 | A * | 12/1997 | Shinohara | 313/584 |
| 5,717,291 | A * | 2/1998 | Kim | 313/582 |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,825,128 | A | 10/1998 | Betsui et al. | |
| 5,952,782 | A | 9/1999 | Nanto | |
| RE37,444 | E | 11/2001 | Kanazawa | |
| 6,373,195 | B1 * | 4/2002 | Whang et al. | 315/169.3 |
| 6,525,469 | B1 * | 2/2003 | Huang et al. | 313/582 |
| 6,583,560 | B1 * | 6/2003 | Amemiya | 313/586 |
| 6,630,916 | B1 | 10/2003 | Shinoda | |
| 6,707,436 | B2 | 3/2004 | Setoguchi et al. | |
| 6,753,645 | B2 | 6/2004 | Haruki et al. | |
| 7,015,643 | B2 * | 3/2006 | Kweon | 313/583 |
| 7,312,576 | B2 * | 12/2007 | Yoo | 313/584 |
| 2001/0048275 | A1 * | 12/2001 | Nakada et al. | 315/160 |
| 2002/0027418 | A1 * | 3/2002 | Huang et al. | 313/584 |
| 2002/0047558 | A1 * | 4/2002 | Whang et al. | 315/169.3 |
| 2002/0145387 | A1 * | 10/2002 | Akiba | 313/586 |
| 2003/0197662 | A1 * | 10/2003 | Huang et al. | 345/60 |
| 2003/0218070 | A1 * | 11/2003 | Tsikos et al. | 235/472.01 |
| 2003/0227427 | A1 | 12/2003 | Kim | |
| 2004/0251829 | A1 * | 12/2004 | Kuroki et al. | 313/582 |
| 2004/0263433 | A1 * | 12/2004 | Nagao et al. | 345/60 |
| 2005/0242722 | A1 * | 11/2005 | Yoo et al. | 313/582 |

FOREIGN PATENT DOCUMENTS

| | | |
|---|---|---|
| JP | 08-045433 | 2/1996 |
| JP | 10-214570 | 8/1998 |
| JP | 2845183 | 10/1998 |
| JP | 2917279 | 4/1999 |
| JP | 2001-043804 | 2/2001 |
| JP | 2001-325888 | 11/2001 |
| JP | 2003-208851 | 7/2003 |

OTHER PUBLICATIONS

*Office Action* from the Japanese Patent Office issued in Applicant's corresponding Japanese Patent Application No. 2005-124238 dated Jan. 29, 2008.

* cited by examiner

PLASMA DISPLAY PANEL HAVING ELECTRODES ARRANGED WITHIN BARRIER RIBS

CLAIM OF PRIORITY

This application makes reference to, incorporates the same herein, and claims all benefits accruing under 35 U.S.C. §119 from an application entitled PLASMA DISPLAY PANEL filed with the Korean Industrial Property Office on 28 Apr. 2004 and there duly assigned Ser. No. 2004-0029649.

BACKGROUND OF THE INVENTION

1. Field of the Invention

The present invention relates to a plasma display panel (PDP), and more particularly, to a design for a PDP that improves luminous efficiency and can operate effectively with low driving voltages.

2. Description of the Related Art

The PDP flat panel display is very thin, light-weight, has a large screen, superior picture quality, and a wide viewing angle. In addition, the PDP can be simply manufactured and easily made to have a large size compared to that of other flat display apparatuses. Accordingly, the PDP is considered to be a next-generation large flat display apparatus.

PDPs are divided into direct current (DC)-PDPs, alternating current (AC)-PDPs, and hybrid PDPs based on the applied discharge voltage. PDPs can further be classified into facing surfaces discharge PDPs and surface discharge PDPs based on the discharge structure.

In DC-PDPs, all electrodes are exposed to a discharge space and charges directly move between corresponding electrodes. In AC-PDPs, at least one electrode is covered with a dielectric layer and a discharge occurs with the aid of wall charges and without the direct movement of charges between corresponding electrodes.

DC-PDPs are disadvantageous in that electrodes may be badly damaged due to direct contact with moving charges between the electrodes. For this reason, recently, AC-PDPs and particularly AC-PDPs having a three-electrode surface discharge structure are often used.

Often, designs for a three electrode surface AC type PDP place electrodes and other layers on the front substrate. This is problematical because visible light that is generated in the display must pass through the same front substrate to be viewed. As a result, much of the visible light never reaches the outside of the display, causing luminous efficiency to decrease.

By having electrodes on the front panel, the plasma must start near the front panel side of the discharge cell, which produces an awkward and an inefficient discharge. Also, such an arrangement of the electrodes and the phosphor layers also results in ions from the plasma to sputter the phosphor layer, especially when the same image is viewed over time, producing a permanent image sticking.

When electrodes are placed on the front substrate, a transparent but highly resistive material is also used for the electrodes thus causing a voltage drop along the electrode and a decay in driving speed and response time. Therefore, what is needed is an improved design for a PDP that overcomes the above problems.

SUMMARY OF THE INVENTION

It is therefore an object of the present invention to provide an improved design for a PDP.

It is also an object of the present invention to provide a design for a PDP that results in improved luminous efficiency.

It is still an object of the present invention to provide a design for a PDP that results in more efficient plasma formation resulting in improved light emission efficiency.

It is also an object of the present invention to provide a design for a PDP that prevents image burn-in caused by charged particles from the plasma from sputtering of the phosphor layers.

It is further an object of the present invention to provide a design for a PDP where the aperture efficiency and transmittance are remarkably increased and a discharge surface is sharply increased.

It is still an object of the present invention to provide a design for a PDP resulting in more efficient use of space-charges in the formation of a plasma.

It is yet an object of the present invention to provide a design for a PDP that results in rapid discharge response and high-speed driving.

These and other objects can be achieved by a PDP that has a plurality of pixels, each pixel includes at least three sub-pixels. Each sub-pixel in turn includes at least two discharge cells. The PDP includes a front panel, a back panel, first barrier ribs, front discharge electrodes, back discharge electrodes, phosphor layers, and a discharge gas. The front panel and the back panel are separated from each other and are parallel to each other. The first barrier ribs are positioned between the front panel and the back panel and define discharge cells together with the front panel and the back panel. The first barrier ribs are made of a dielectric material. The front discharge electrodes are located within the first barrier ribs and surround the discharge cells. The back discharge electrodes are also located within the first barrier ribs and also surround the discharge cells and are separated from the front discharge electrodes. The phosphor layers are located inside the discharge cells, respectively. The discharge gas is present within the discharge cells.

The discharge electrodes have a ladder shape, each ladder corresponding to a row of discharge cells. In one embodiment, where two discharge cells are in each sub-pixel, the discharge electrodes for each sub-pixel are two ladders (or prongs) in parallel to each other. The two ladders for a sub-pixel are electrically connected to each other at a terminal end of the display. In first barrier ribs that are formed within a single sub-pixel, one side of each of the two ladders extend in parallel. Thus, such a barrier rib must be designed to be thick enough to accommodate each prong of each discharge electrode.

In another embodiment, the two ladders that make up the front discharge electrodes for a row of sub-pixels are merged together to form a grid like structure. Also, the two ladders that make up the back discharge electrodes are also merged together. This results in one instead of two electrode lines in the barrier rib formed within a single sub-pixel for each of the front and the back discharge electrodes. In such a design, since there is fewer prongs, the first barrier rib can be designed to be narrower. Where the first barrier rib is made more narrow, the second barrier ribs are also made narrower to match the first barrier ribs.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
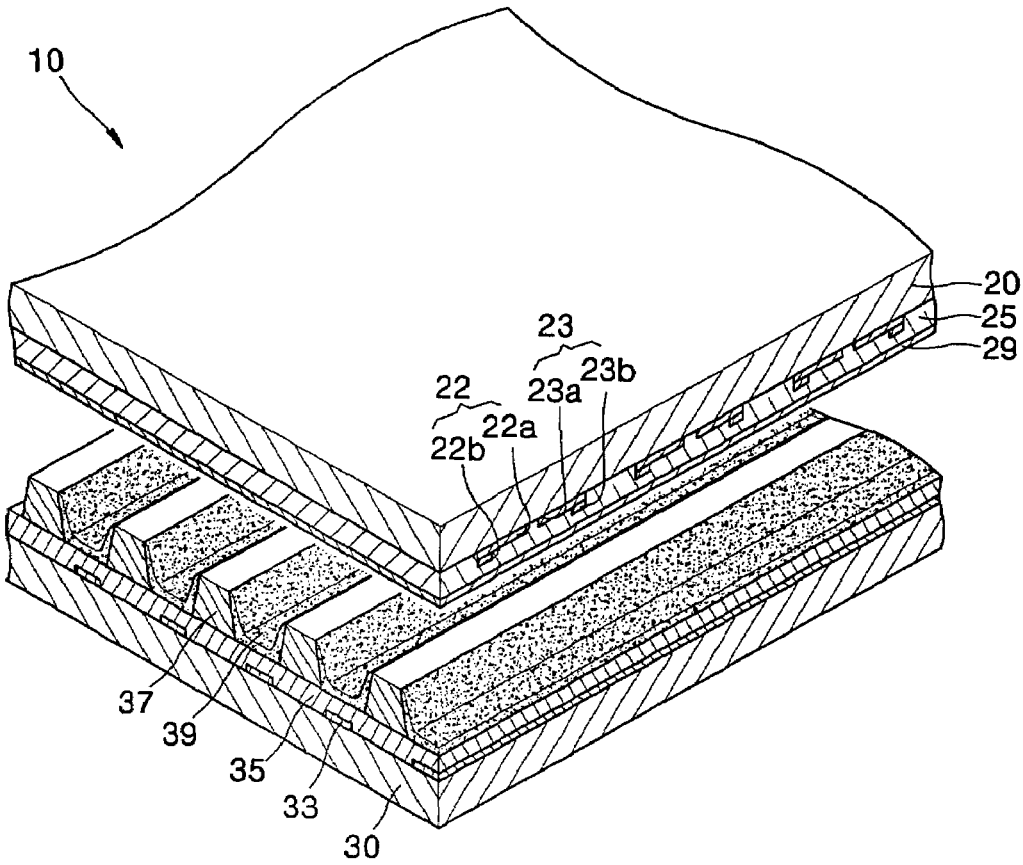
FIG. 1 (PRIOR ART)
FIG. 1 is a perspective view of a plasma display panel (PDP)

Turning now to the figures, FIG. 1 illustrates a three-electrode surface discharge AC PDP 10 similar to that disclosed in, for example, U.S. Pat. No. 6,753,645 to Haruki et al. Referring to FIG. 1, the three-electrode surface discharge AC-PDP 10 includes a front panel 20 and a back panel 30.

On the back panel 30, address electrodes 33 that generate an address discharge, a back dielectric layer 35 covering the address electrodes 33, barrier ribs 37 defining discharge cells, and phosphor layers 39 arranged on side walls of the barrier ribs 37 and on portions of the back panel 30 not covered by barrier ribs 37 are arranged.

On the front panel 20 positioned facing and separated from the back panel 30, X-electrodes 22 and Y-electrodes 23 that generate sustain discharge, a front dielectric layer 25 covering the X- and Y-electrodes 22 and 23, and a protective layer 29 are arranged. Here, the X-electrodes 22 can include a transparent X-electrode 22*a* and a bus X-electrode 22*b* located at one side of the transparent X-electrode 22*a* to compensate for voltage drops along the transparent X-electrode 22*a*. The Y-electrodes 23 can include a transparent Y-electrode 23*a* and a bus Y-electrode 23*b* located on one side of the transparent Y-electrode 23*a* to compensate for voltage drops along the transparent Y-electrode 23*a*.

In the three-electrode surface discharge AC-PDP 10 of FIG. 1, transparent X-electrodes 22*a*, bus X-electrodes 22*b*, transparent Y-electrodes 23*a*, bus Y-electrodes 23*b*, the front dielectric layer 25, and the protective layer 29 are present on the front panel 20 through which visible rays must pass to be seen. Because the visible light must pass through the front panel 20 populated with the X and Y electrodes 22 and 23 and the front dielectric layer 25, only 60% of the visible light can transmit through this front panel 20. Moreover, in the three-electrode surface discharge AC-PDP 10 of FIG. 1, electrodes generating discharge are arranged on an upper side of the discharge space, i.e., on the inside of the front panel 20 through which visible rays pass. In such arrangement, discharge is generated from the inside of the front panel 20 and then diffused, and with such an arrangement, the light emission efficiency is low. Furthermore, when the three-electrode surface discharge AC-PDP 10 is used during a long period of time, ion sputtering on phosphor layers by charged particles of a discharge gas due to an electric field may occur, thus causing a permanent after-image burn-in.

Figure 2:
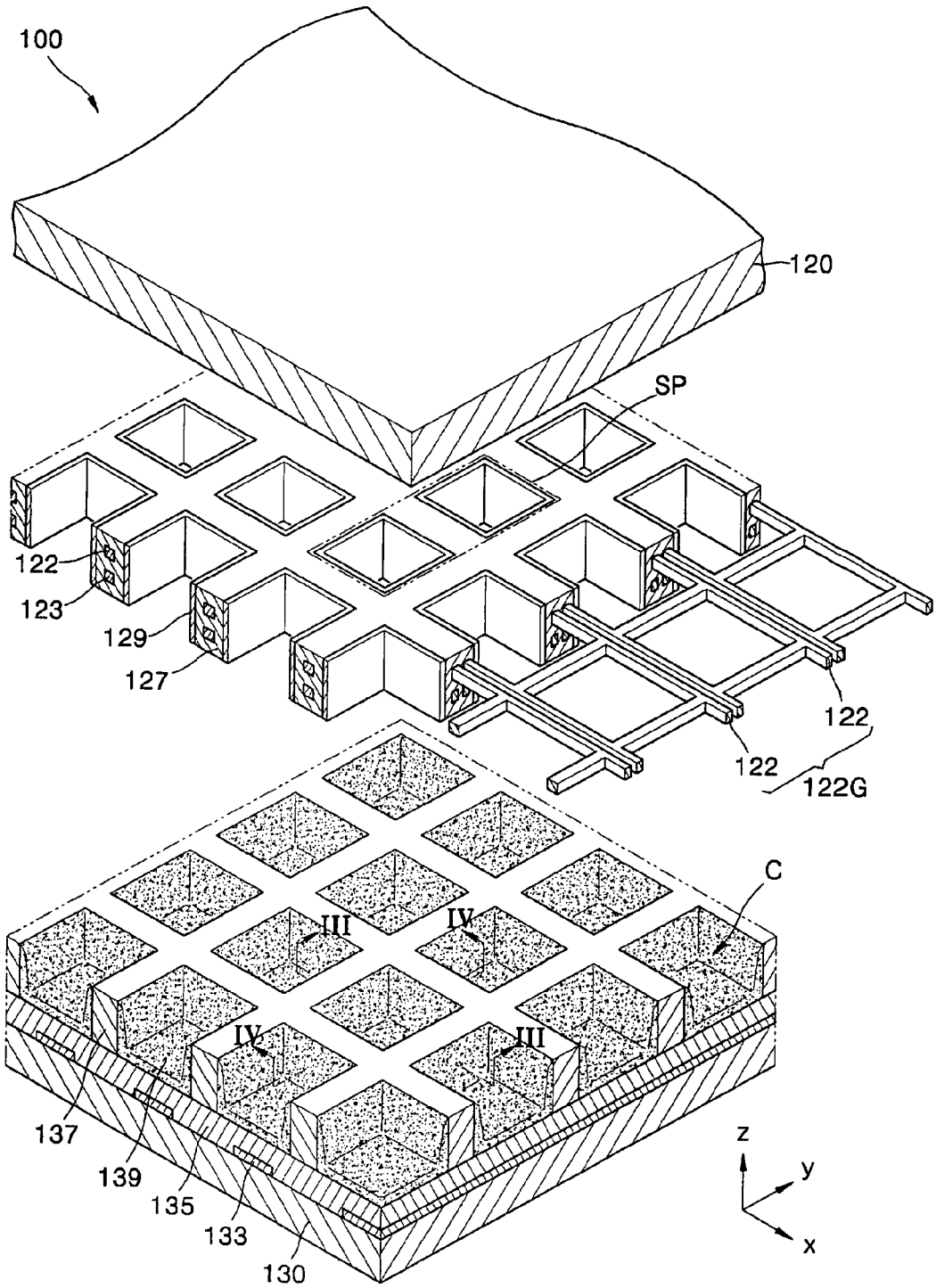
FIG. 2 is a perspective view of a PDP according to a first embodiment of the present invention.
Figure 3:
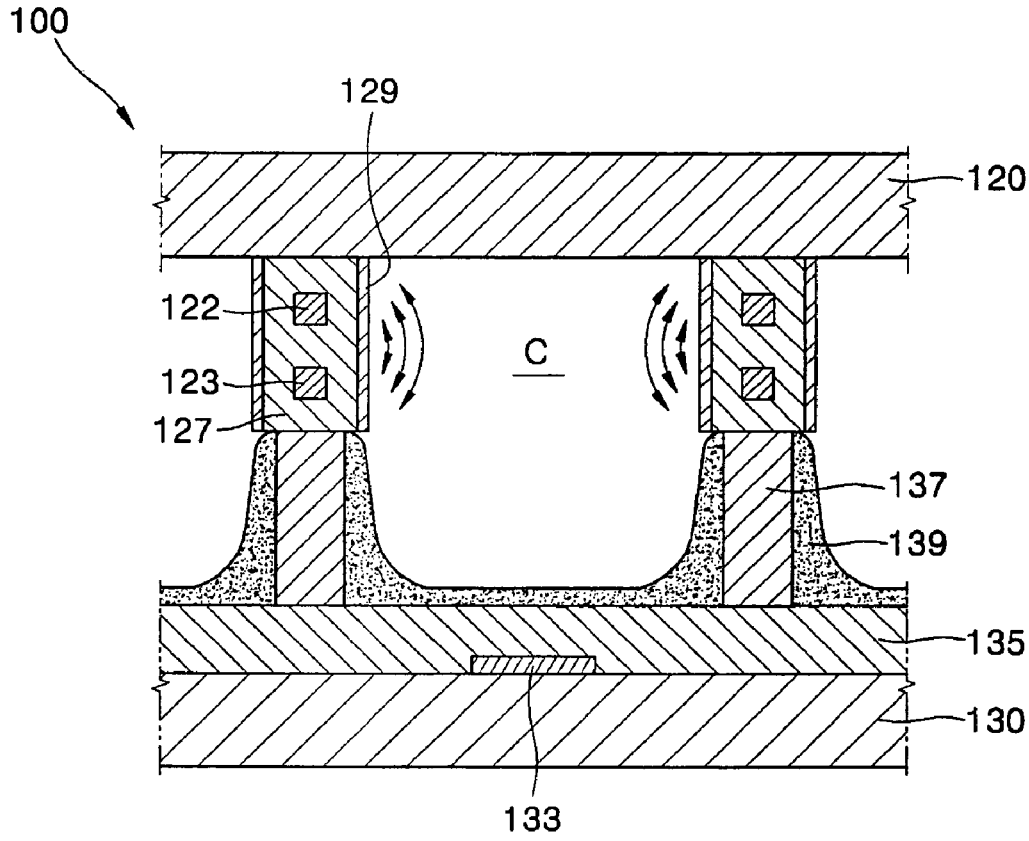
FIG. 3 is a sectional view of the PDP of FIG. 2 taken along the line III-III.
Figure 4:
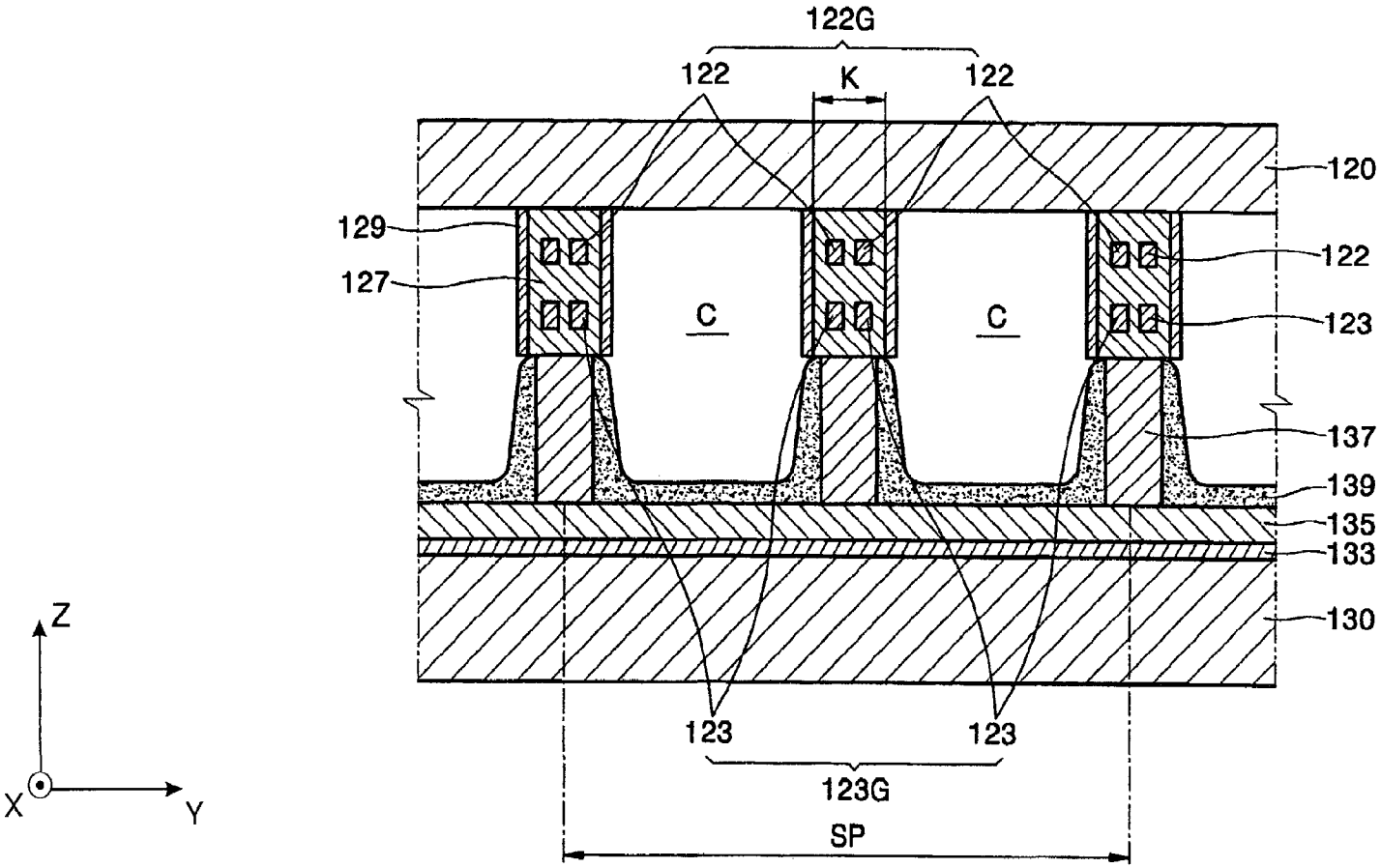
FIG. 4 is a sectional view of the PDP of FIG. 2 taken along the line IV-IV.

Turning now to FIGS. 2 through 4, FIGS. 2 through 4 are views of a PDP 100 according to a first embodiment of the present invention. Referring to FIGS. 2 through 4, PDP 100 includes a front panel 120, front discharge electrodes 122, back discharge electrodes 123, a back panel 130, first barrier ribs 127, phosphor layers 139, and a discharge gas (not illustrated). The front panel 120 is transparent and allows for the transmission of visible rays and projects an image and is oriented to be parallel to the back panel 130. The front panel 120 and the back panel 130 are usually made using a material having glass as a main component.

The first barrier ribs 127 are provided between the front panel 120 and the back panel 130. The first barrier ribs 127 are positioned in a non-discharge portion to define discharge cells C. Front discharge electrodes 122 and back discharge electrodes 123 are positioned within the first barrier ribs 127 and surround the discharge cells C.

Here, a single pixel includes three or more sub-pixels (SP) and each sub-pixel SP includes at least two discharge cells C. Often, a single pixel is made up of just three sub-pixels SP where a single pixel includes a red sub-pixel emitting red visible rays, a green sub-pixel emitting green visible rays, and a blue sub-pixel emitting blue visible rays.

In an embodiment of the present invention, a single sub-pixel (SP) in turn is made up of two or more discharge cells C. Accordingly, at least one first barrier rib 127 defining discharge cells C is formed to pass through a single sub-pixel SP and thus is located entirely within a single sub-pixel and does not form a boundary between two different sub-pixels. The first barrier ribs 127 separate adjacent discharge cells C from each other. The first barrier ribs 127 are preferably made out of a dielectric material, thus preventing the back discharge electrodes 123 and the front discharge electrodes 122 from being directly and electrically connected to each other during a sustain discharge. The dielectric material also prevents charged particles from directly colliding with and damaging the front and back discharge electrodes 122 and 123, and the dielectric material allows wall charges to accumulate by inducing charged particles. These wall charges are then used to initiate the sustain discharge.

Second barrier ribs 137 can be arranged between the first barrier ribs 127 and the back panel 130. Here, the second barrier ribs 137 also define the discharge cells C together with the first barrier ribs 127 and also serve to prevent erroneous discharge from occurring between neighboring discharge cells C. In FIG. 2, the second barrier ribs 137 define the discharge cells C as having a matrix shape, but the present invention is not restricted thereto. The second barrier ribs 137 can define the discharge cells C as having other shapes instead. In addition, a horizontal cross-section of each discharge cell C defined by the second barrier ribs 137 has a rectangular shape in FIG. 2, but the present invention is not restricted thereto. The discharge cells C may instead be formed to have a horizontal cross-section having a polygonal shape such as a triangle or a pentagon shape, or other closed shapes such as a circle or an ellipse. The first barrier ribs 127 and the second barrier ribs 137 can be integrally formed.

The front discharge electrodes 122 and the back discharge electrodes 123 are both located within the first barrier ribs 127. The front and back discharge electrodes 122 and 123 can be made out of a conductive metal such as aluminum, copper, or silver. The front discharge electrodes 122 and the back discharge electrodes 123 can be oriented to cross over each other. In detail, a front discharge electrode 122 can extend along discharge cells C in one direction and a back discharge electrode 123 can extend along discharge cells C in another direction that crosses the one direction that the front discharge electrodes 122 extend. Here, one of the front discharge electrode 122 and the back discharge electrode 123 can serve both as an address electrode to generate an address discharge and later as a sustain electrode to generate the sustain discharge. In such a configuration, a separate set of address electrodes 133 is not implemented where the front and back discharge electrodes cross each other.

Alternatively, the front discharge electrodes 122 and the back discharge electrodes 123 can both extend in the same one direction (e.g., an x-direction) and thus are parallel to each other. In such a scenario, separate address electrodes 133 can extend in another direction (e.g., a y-direction) that crosses the front discharge electrodes 122 and the back discharge electrodes 123. When the front discharge electrodes 122 and the back discharge electrodes 123 cross the address electrodes 133, columns of discharge cells C through which the address electrodes 133 pass cross columns of discharge cells C through which the front discharge electrodes 122 and the back discharge electrodes 123 pass. Also, since the front discharge electrodes 122 and the back discharge electrodes 123 are parallel to each other, the front discharge electrodes 122 are spaced apart from the back discharge electrodes 123 at predetermined intervals. In this scenario, the front discharge electrodes 122 and the back discharge electrodes 123 are used to generate the sustain discharge. Between the front discharge electrodes 122 and the back discharge electrodes 123, a sustain discharge for forming an image on the PDP 100 occurs.

The address electrodes 133 are provided to generate address discharge in order to facilitate the sustain discharge between the front discharge electrodes 122 and the back discharge electrodes 123. More specifically, the address electrodes 133 serve to lower a potential difference needed to initiate the sustain discharge, thus allowing the PDP 100 to operate at lower driving voltages. In this case, it is preferable that the address electrodes 133 are positioned on the back panel 130 between the back panel 130 and the dielectric layer 135. On the other side of the dielectric layer 135 is the phosphor layers 139 and the second barrier ribs 137. Here, the back panel 130 supports the address electrodes 133 and the dielectric layer 135. When the back discharge electrodes 123 function as scan electrodes and the front discharge electrodes 122 function as common electrodes, address discharge is generated between the front discharge electrodes 122 and the back discharge electrodes 123. When the address discharge ends, positive ions are accumulated on the back discharge electrodes 123 and electrons are accumulated on the front discharge electrodes 122, thus facilitating sustain discharge between the front discharge electrodes 122 and the back discharge electrodes 123.

In FIG. 2, each of the front discharge electrode 122 and the back discharge electrode 123 is implemented as a single electrode. However, each of these electrodes can instead include at least two sub-electrodes.

As described before, the address electrodes 133 can be covered with the dielectric layer 135. The dielectric layer 135 can be made using a dielectric material such as PbO, $B_2O_3$, or $SiO_2$. Such dielectric materials serve to protect the address electrodes 133 underneath from damage caused by the collision of positive ions or electrons with the address electrodes 133. Dielectric layer 135 can also serve to induce charges.

The first barrier ribs 127 can be covered with a protective layer 129. Although the protective layer 129 is not an essential element, it is preferable that the protective layer 129 is provided since such a protective layer 129 serves to protect the first barrier ribs 127 from damage caused by collision with charged particles. Protective layer 129 also serves to emit secondary electrons during discharge.

A phosphor layer 139 is provided in each discharge cell C. In particular, when the PDP 100 includes second barrier ribs 137, phosphor layers 139 are located in portions of the discharge cells C corresponding to the second barrier ribs 137 and are not located in portions of the discharge cells C corresponding to the first barrier ribs 127. In this case, the phosphor layers 139 can be located on the same level as the second barrier ribs 137. The first barrier ribs 127 can made out of a dielectric material to facilitate generation of sustain discharge and to provide excellent memory characteristics, and the phosphor layers 139 can be located on the sidewalls of the second barrier ribs 137 which are positioned below the first barrier ribs 127. This allows visible rays to be generated in a wide area. Here, it is preferable that the front discharge electrodes 122 and the back discharge electrodes 123 are designed to surround an upper portion of the discharge cells C corresponding to the first barrier ribs 127 and are not designed to surround a lower portion of the discharge cells C corresponding to the second barrier ribs 137. When the second barrier ribs 137 are provided, the upper portions of the discharge cells C are portions that are above (or closer to the front panel 120) than the phosphor layers 139 and the second barrier ribs 137.

The phosphor layers 139 include a materials that receive ultraviolet rays emitted from the sustain discharge and emits visible rays as a result. A phosphor layers 139 located within a red sub-pixel includes phosphor such as $Y(V,P)O_4$:Eu, a phosphor layers 139 located within a green sub-pixel includes phosphor such as $Zn_2SiO_4$:Mn, a phosphor layers 139 located within a blue sub-pixel includes phosphor such as BAM:Eu.

A discharge gas (not illustrated) is also present in the discharge cells C. The discharge gas is preferably a penning mixture such as Xe—Ne, Xe—He, or Xe—He—He. Xe is used as a main discharge gas since Xe does not dissociate because Xe is a chemically stable inert gas. In addition, since Xe has a high atomic number, an excitation voltage is lower and a waveform of emitted light. He or Ne are used as a buffer gas since these gases reduce a decrease in voltage due to a penning effect of Xe and a sputtering effect due to high pressure.

Figure 5A:
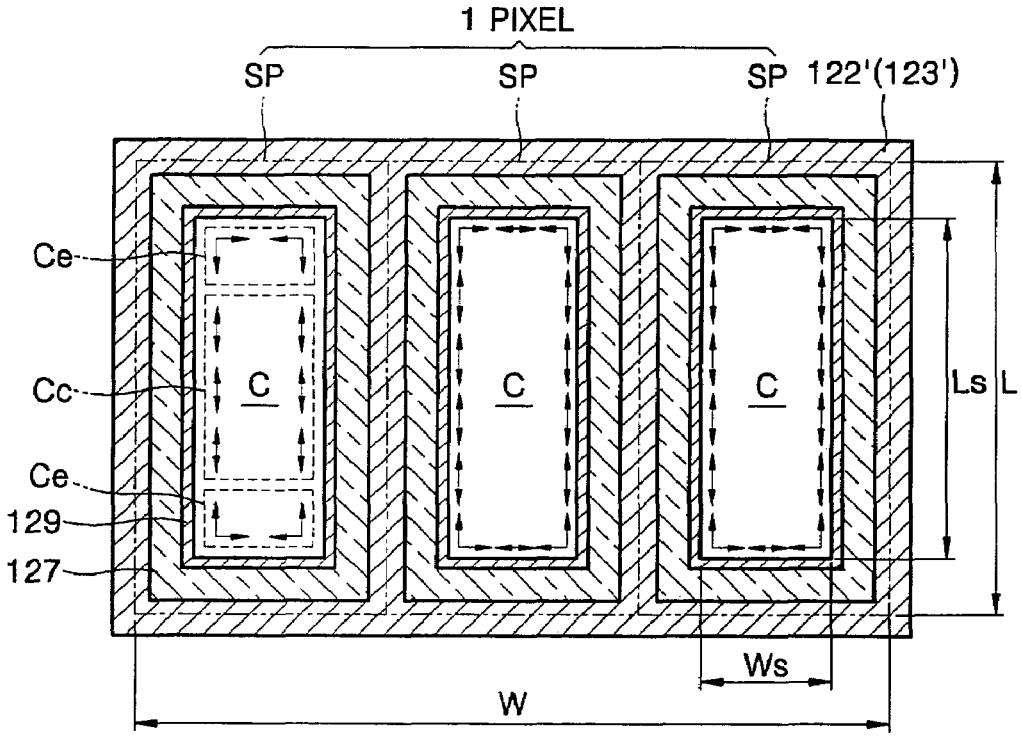
FIGS. 5A and 5B are sectional views of a single pixel including sub-pixels and discharge cells.

In the embodiments of the present invention, a single sub-pixel SP includes at least two discharge cells C. Turning to FIG. 5A, FIG. 5A illustrates the case of where there is only one discharge cell for each sub-pixel and three sub-pixels for each pixel. In particular, as illustrated in FIG. 5A, a ratio of a longitudinal length L of a single pixel to a latitudinal length W thereof, i.e., an aspect ratio, is about 1:1. Accordingly, when a single pixel includes three red, green, and blue sub-pixels SP, an aspect ratio, i.e., a ratio of a longitudinal length Ls of a single sub-pixel to a latitudinal length Ws of thereof, is 3:1. Consequently, as illustrated in FIG. 5A, when a single discharge cell C constitutes a single sub-pixel SP, a discharge central region Cc is bigger than a discharge edge region Ce.

In this situation, when a front discharge electrode 122' and aback discharge electrode 123' are positioned within a first barrier rib 127 that defines the discharge cell C and the front discharge electrode 122' and the back discharge electrode 123' form corners at discharge edge regions Ce of discharge cell C, one of two problems will occur depending on the magnitude of the discharge voltage that is applied. When the applied discharge voltage is low, discharge is concentrated at the discharge edge regions Ce. When the applied discharge voltage is high, a dielectric material that makes up the first barrier rib 127 at the edge regions Ce of the discharge cells gets damaged. In either case, an abnormal discharge results, and it is also difficult to expand a discharge area using the design of FIG. 5A.

Figure 5B:
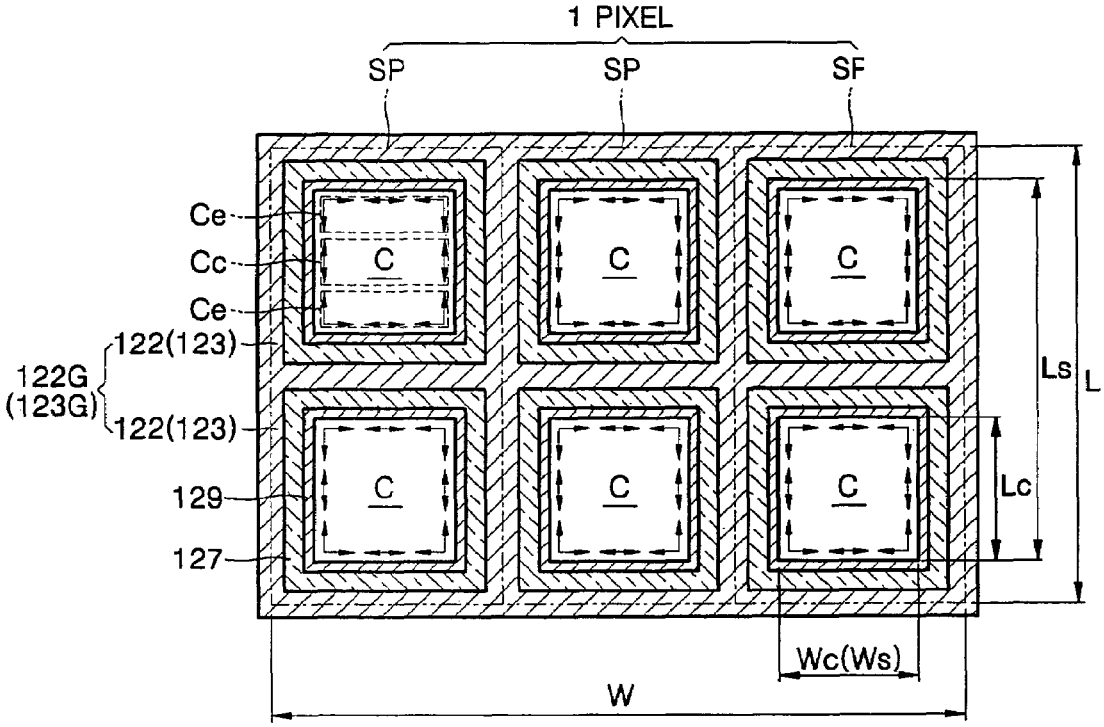

Turning now to FIG. 5B, FIG. 5B illustrates an embodiment of the present invention where a single sub-pixel SP is made up of more than one discharge cell C. As illustrated in FIG. 5B, each sub-pixel SP is made up of two discharge cells C. Although FIG. 5B illustrates each sub-pixel SP as having two discharge cells C, the present invention is in no way limited to this. It is also possible to make each sub-pixel SP have more than two discharge cells, however two is preferred and is thus illustrated in FIG. 5B. Since the aspect ratio Ls/Ws of a single sub-pixel SP is 3:1, when the single sub-pixel SP is made of two discharge cells C, the aspect ratio of a single discharge cell C, i.e., a ratio of a longitudinal length Lc of the discharge cell C to a latitudinal length Wc thereof, becomes about 1.0:1.2. In such a design for a discharge cell C, there is no region of the discharge cell C where discharge does not occur, regardless of the magnitude of the applied discharge voltage. Consequently, charged particles are uniformly discharged.

Figure 6:
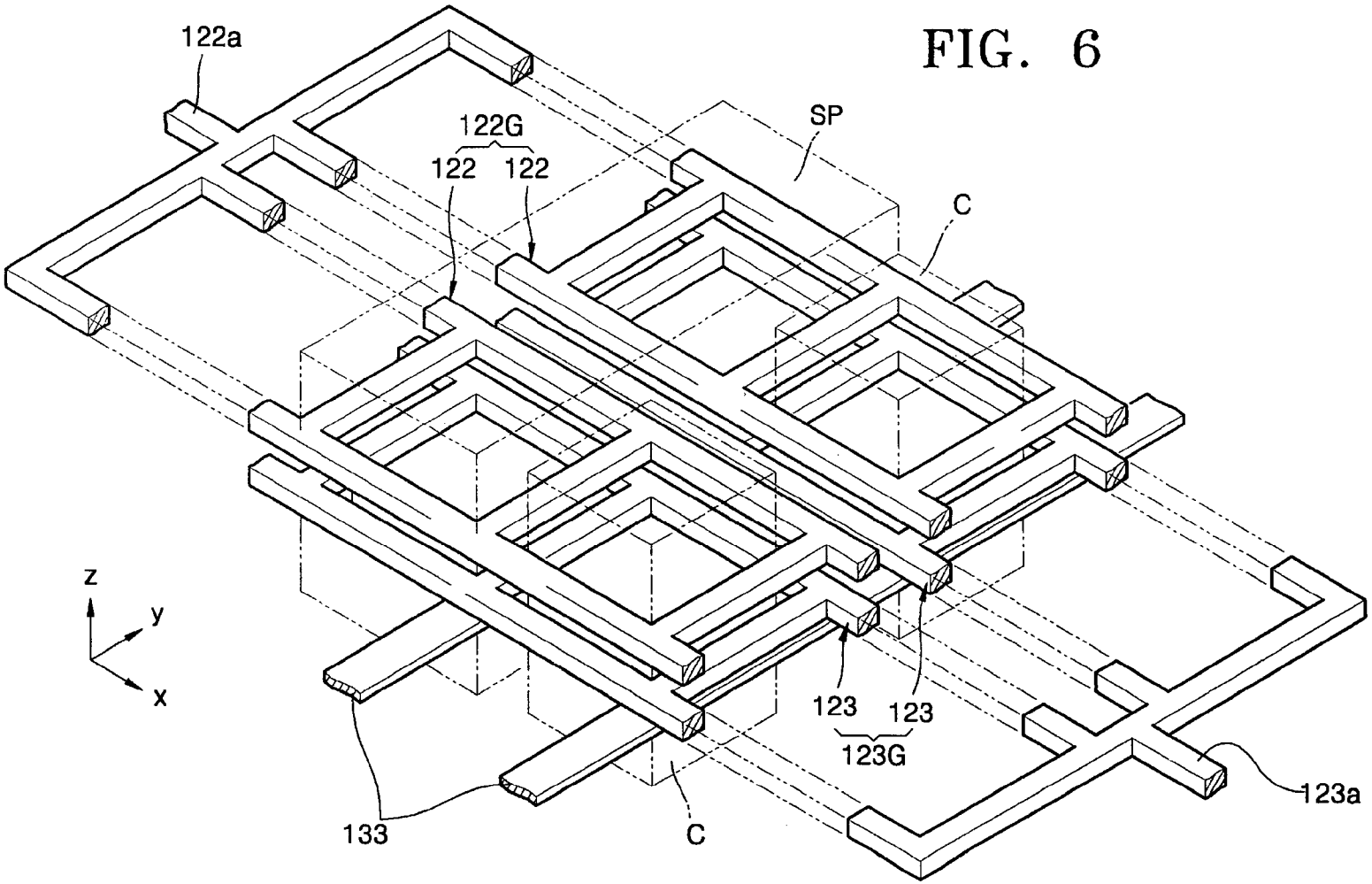
FIG. 6 is a perspective view of electrodes included in the PDP illustrated in FIG. 2.

Turning now to FIG. 6, FIG. 6 illustrates a perspective view of electrodes included in the PDP 100 of FIG. 2 according to the first embodiment of the present invention. Referring to FIG. 6, each of the front discharge electrodes 122 and the back discharge electrodes 123 can have a ladder shape extending in one direction (e.g., an x-direction) along a line (or row) of discharge cells C. In other words, in a single sub-pixel SP, front discharge electrodes 122 can separately and respectively extend for each row of discharge cells C as two prongs. In the same manner, back discharge electrodes 123 can separately and respectively extend for each row of discharge cells C again as two prongs. Although both prongs are electrically connected at the edge or terminal ends of the display, they extend separately inside the display area of the PDP. In FIG. 6, two discharge cells C are illustrated as being in a single sub-pixel SP. Thus, running through each sub-pixel are two ladder sets (or prongs) for the front discharge electrode 122 and two ladder sets (or prongs) for the back discharge electrode 123, one ladder set for each discharge cell C in the sub-pixel SP.

In one sub-pixel SP, the same discharge and light emission occurs during the same period. Accordingly, the separate front discharge electrode prongs 122 form a single front discharge electrode group 122G connected to one terminal 122*a* so that they drive one sub-pixel SP together by applying the same voltages simultaneously for each discharge cell C within a sub-pixel SP. In the same manner, the separate back discharge electrode prongs 123 form a single back discharge electrode group 123G connected to one terminal 123*a* so that they drive one sub-pixel SP together. Accordingly, within first barrier ribs 127 (FIG. 2) that separate adjacent sub-pixels SP, front discharge electrodes 122 are separately disposed. In the same manner, back discharge electrodes 123 are separately disposed within the first barrier ribs 127 that separate adjacent sub-pixels SP.

Turning now to FIG. 4, FIG. 4 illustrates a cross section of the PDP 100 of FIG. 2 looking in the −x direction where the cross section of first barrier ribs 122 that are formed within a single sub-pixel are illustrated. Referring to FIG. 4, for front discharge electrodes 122 located within a first barrier rib 127 that separates two discharge cells C but is within a single sub-pixel SP, the front discharge electrodes 122 are separated from each other as two separate strands side-by-side within first barrier rib 127. Similarly, the back discharge electrodes 123 located within the first barrier rib 127 in a single sub-pixel SP are also separated from each other as two separate strands. By having more than one front discharge electrode strand and more than one back discharge electrode strand in a single first barrier rib 127 member, the first barrier rib member 127 must be big enough to accommodate each of these electrode strands from different prongs. This results in a first barrier rib member that is within a single sub-pixel SP to have a thickness K that is not any narrower than first barrier rib members that are formed between two different sub-pixels SP. With such a wide first barrier rib member within a single sub-pixel and not between two different sub-pixels, the size of the discharge area is reduced. This is because the thicker the barrier rib is, the less room is left over for the discharge area and the discharge area thus becomes smaller. In order to increase a size of the discharge area, this thickness of first barrier rib members located within a single sub-pixel can be decreased by changing the electrode design from that FIGS. 2 and 6 to that of FIGS. 7 and 8.

Figure 7:
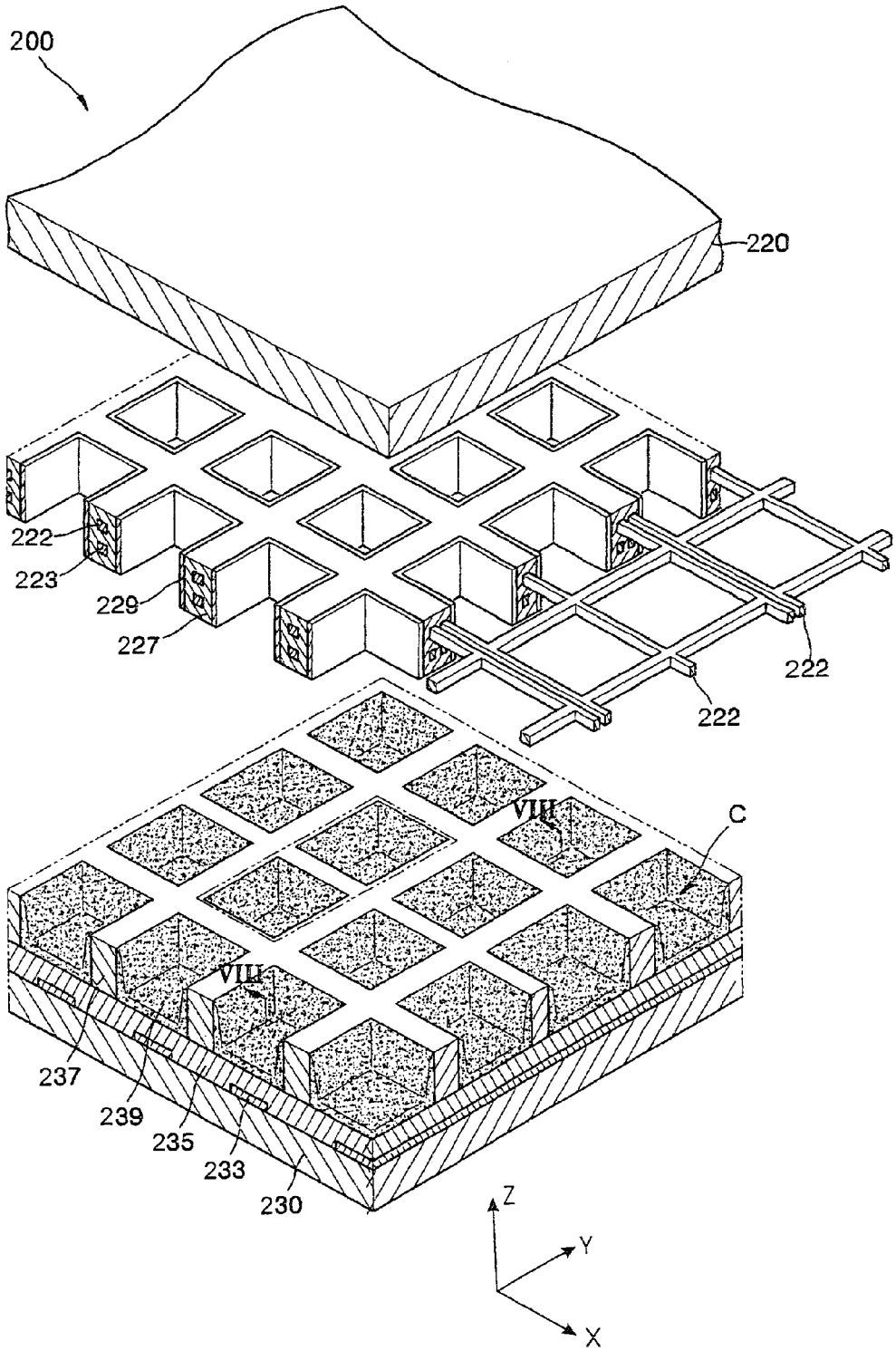
FIG. 7 is a perspective view of a PDP according to a second embodiment of the present invention.
Figure 8:
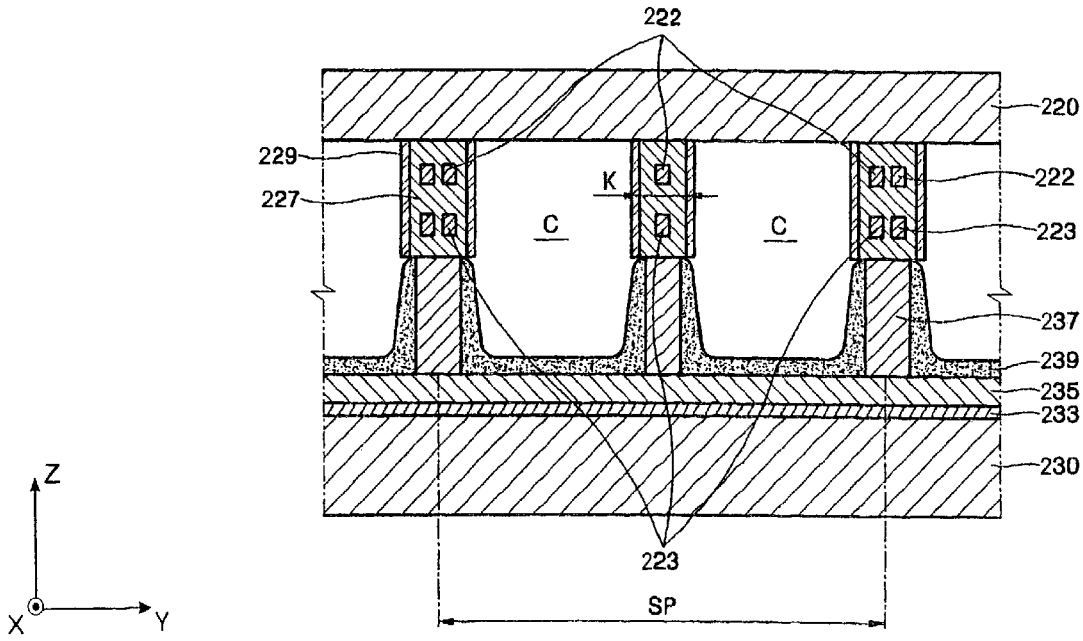
FIG. 8 is a sectional view of the PDP of FIG. 7 taken along the line VIII-VIII.

Turning now to FIGS. 7 and 8, FIGS. 7 and 8 illustrates a PDP 200 according to a second embodiment of the present invention. As illustrated in FIGS. 7 and 8, only one front discharge electrode 222 strand and only one back discharge electrode 223 strand is located within a first barrier rib 227 that is within a single sub-pixel and separates discharge cells C. In other words, each of the front discharge electrode 222 and the back discharge electrode 223 that drives a line of sub-pixels SP has a multi-ladder shape extending along a plurality of lines (or rows) of discharge cells C. In the multi-ladder shape of FIGS. 7 and 8, the two prongs of the front discharge electrodes 222 are merged together into a single prong. The same merging also occurs with the back discharge electrodes 223. By merging the two prongs together, the thickness K of the first barrier rib 227 that is within a single sub-pixel can be made narrower than in the first embodiment, resulting in a larger discharge area. This is because each of the front discharge electrodes 222 and the back discharge electrodes 223 in the first barrier rib 227 within a single sub-pixel SP has just one strand instead of two. This second embodiment is more preferable since a discharge area is greater in each single sub-pixel. Accordingly, the thickness K of the first barrier rib 227 that separates the adjacent discharge cells C included in a single sub-pixel SP becomes narrower than in the first embodiment resulting in larger adjacent discharge cells C. As a result, a discharge area in the sub-pixel SP increases over that of the first embodiment.

In the second embodiment of FIGS. 7 and 8, the multi-ladder shape is a discharge electrode having a ladder shape corresponding to a line of discharge cells C that is combined (or merged) with a discharge electrode having a ladder shape corresponding to an adjacent line of discharge cells C, as illustrated in FIG. 7. As a result, in portions of the first barrier rib 227 that is located within a single sub-pixel, only one front discharge electrode strand 222 and one back discharge electrode strand 223 is present instead of two strands each. Because less electrode prongs are within first barrier ribs that are within a single sub-pixel SP, these first barrier ribs 227 can be made narrower than in the first embodiment. When these portions of the first barrier ribs 227 are narrower, there is more room left over for the discharge area.

In summary, in both the first and the second embodiments, the transparent X- and Y-electrodes 22*a* and 23*a* made using an indium tin oxide (ITO) layer, the bus X- and Y-electrodes 22*b* and 23*b* made using metal, the front dielectric layer 25 covering the electrodes 22*a*, 23*a*, 23*a*, and 23*b*, and the protective layer 29, which are present on the front panel 20 of the PDP 10 illustrated in FIG. 1, are not present in the front panels 120 and 220 of the PDPs 100 and 200 according to the embodiments of the present invention, thus remarkably increasing light transmittance of visible rays from 60% to 90%. Accordingly, when an image is displayed at a same conventional level of brightness as that of PDP 10 in the PDPs 100 and 200, the front discharge electrodes 122 and 222 and the back discharge electrodes 123 and 223 can be driven at a lower voltage to achieve this same brightness, and therefore, light emission efficiency increases.

Since a front discharge electrodes 122 and 222 and a back discharge electrode 123 and 223 respectively functioning as an X-electrode and a Y-electrode are not located on the front panel 120/220 through which visible rays pass but are instead located at sides of a discharge cell C, it is not necessary to use a transparent electrode having high resistance as a discharge electrode, but an electrode, e.g., a metal electrode, having low resistance can be used instead as the discharge electrode. Accordingly, a rapid discharge response and low-voltage driving without deformation of a waveform can be accomplished.

A PDP according to the embodiments of the present invention provides the following effects:

First, as described above, since a front panel through which visible rays pass includes no electrode or dielectric elements, aperture efficiency remarkably increases, and transmittance can be increased from 60% to 90%.

Second, since an aspect ratio of a discharge cell becomes closer to 1:1, a discharge area is uniformly expanded, an electric field is concentrated towards the center of the discharge cell, and abnormal discharge is prevented. As a result, light emission efficiency increases. In addition, since discharge begins from sides forming a discharge space and extends towards the center of the discharge space, plasma is also concentrated into the center of the discharge space. Plasma is also concentrated into the center of the discharge space due to the effect of an electric field induced by a voltage applied to discharge electrodes formed at the sides of the discharge space. As a result, space charges can be utilized better for discharge.

Third, the volume and quantity of plasma is greatly increased. In the PDPs according to the present invention, discharge begins from sides forming a discharge space and extends towards the center of the discharge space. Accordingly, the volume of plasma is greatly increased due to discharge, and therefore, the quantity of plasma is also greatly increased. As a result, a large amount of ultraviolet rays can be generated.

Fourth, light emission efficiency is remarkably increased. Due to the above-described effects, the PDPs according to the present invention can be driven at a low voltage, and therefore, light emission efficiency can be enormously increased.

Fifth, even when a high-density Xe gas is used for the discharge gas, light emission efficiency is increased. When the high-density Xe gas is used as the discharge gas to increase light emission efficiency, it is generally difficult to drive a PDP at a low voltage. However, the PDPs according to the present invention can be driven at a low voltage and thus enable low-voltage driving even when the high-density Xe gas is used as the discharge gas. As a result, light emission efficiency can be increased.

Sixth, rapid discharge response and low-voltage driving can be accomplished. In the PDPs according to the present invention, discharge electrodes are not located on a front panel through which visible rays must pass but are instead located at sides of a discharge space. Accordingly, it is not necessary to use transparent electrodes having high resistance as the discharge electrodes. Since only highly conductive metal electrodes are used as the discharge electrodes, rapid discharge response and low-voltage driving without deformation of a waveform can be accomplished.

Seventh, a permanent after-image burn-in is essentially prevented in the PDPs as designed according to the present invention. In the PDPs according to the present invention, plasma is concentrated at a center of the discharge space due to an electric field induced by a voltage applied to the discharge electrodes located around the sides of the discharge space. Accordingly, even when discharge continues for a long period of time, ions generated by the discharge are prevented from colliding with the phosphor layers due to the electric field. As a result, a problem of the permanent after-image caused by phosphor damage due to ion sputtering can be fundamentally prevented. In particular, the problem of permanent after-image burn in becomes worse when a high-density Xe gas is used as the discharge gas. However, in the PDP designs of the present invention, even when the discharge gas is a high-density Xe gas, the permanent after-image burn in problem is still avoided.

While the present invention has been particularly illustrated and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel (PDP), comprising:

a front panel;

a back panel arranged parallel to and separated from the front panel;

a plurality first barrier ribs arranged between the front panel and the back panel, the first barrier ribs defining discharge cells together with the front panel and the back panel, the first barrier ribs being of a dielectric material, the first barrier ribs extending in a first direction and in a second direction that crosses the first direction;

a plurality of front discharge electrodes surrounding the discharge cells;

a plurality of back discharge electrodes surrounding the discharge cells, the back discharge electrodes being separated from the front discharge electrodes, wherein at least one of said first barrier ribs that extend in said first direction includes more than one of said front discharge electrodes and at least one of said back discharge electrodes;

phosphor layers arranged within the discharge cells, respectively; and a discharge gas arranged within the discharge cells, the PDP further comprising a plurality of pixels, each of said pixels includes at least three sub-pixels, each sub-pixel includes at least two discharge cells.

2. The PDP of claim 1, each sub-pixel being composed of two discharge cells.

3. The PDP of claim 1, wherein each of said first barrier ribs that extend in said first direction includes one pair of said plurality of front discharge electrodes and one pair said plurality of back discharge electrodes.

4. The PDP of claim 1, wherein only alternating ones of said plurality of first barrier ribs that extend in said first direction includes more than one of said front discharge electrodes and at least one of said back discharge electrodes.

5. The PDP of claim 1, the front discharge electrodes extend in the first direction and the back discharge electrodes extend in the second and different direction and cross the front discharge electrodes.

6. The PDP of claim 1, the front discharge electrodes and the back discharge electrodes being parallel to each other and extending in the first direction, the PDP further comprising address electrodes that extend in the second and different direction that crosses both the front discharge electrodes and the back discharge electrodes.

7. The PDP of claim 6, further comprising a dielectric layer arranged between the phosphor layers and the address electrodes, the address electrodes being arranged between the back panel and the phosphor layers.

8. The PDP of claim 1, further comprising a protective layer covering at least sides of the first barrier ribs.

9. A plasma display panel (PDP), comprising:

a front panel;

a back panel arranged parallel to and separated from the front panel;

a plurality of first barrier ribs arranged between the front panel and the back panel, the first barrier ribs defining discharge cells together with the front panel and the back panel, the first barrier ribs being of a dielectric material, the first barrier ribs extending in a first direction and in a second direction that crosses the first direction;

a plurality of front discharge electrodes surrounding the discharge cells;

a plurality of back discharge electrodes surrounding the discharge cells, the back discharge electrodes being separated from the front discharge electrodes, wherein at least one of said first barrier ribs that extend in said first direction includes more than one of said front discharge electrodes and more than one of said back discharge electrodes;

phosphor layers arranged within the discharge cells, respectively; and a discharge gas arranged within the discharge cells, the PDP further comprising a plurality of pixels, each of said pixels includes at least three sub-pixels, each sub-pixel includes at least two discharge cells, the front discharge electrodes and the back discharge electrodes being arranged so that identical voltage signals are simultaneously applied for each discharge cell within a sub-pixel.

10. The PDP of claim 9, wherein each of said first barrier ribs that extend in said first direction includes more than one of said front discharge electrodes and more than one of said back discharge electrodes.

11. The PDP of claim 10, wherein each of said first barrier ribs that extend in said first direction includes two of said front discharge electrodes and two of said back discharge electrodes.

12. The PDP of claim 9, wherein each of said first barrier ribs that extend in said second direction includes only one of said front discharge electrodes and only one of said back discharge electrodes.

13. The PDP of claim 9, further comprising a plurality of second barrier ribs defining the discharge cells together with the first barrier ribs, the phosphor layers being arranged on a same level as the second barrier ribs, the second barrier ribs being closer to the back panel than the first barrier ribs.

14. The PDP of claim 13,the front panel being transparent.

15. The PDP of claim 14, the second barrier ribs being of a same size and shape as that of the first barrier ribs.

16. The PDP of claim 9, wherein only alternating ones of said first barrier ribs that extend in said first direction includes more than one of said front discharge electrodes and more than one of said back discharge electrodes.

17. The PDP of claim 16, each of said first barrier ribs that extend in said second direction includes only one of said front discharge electrodes within and only one of said back discharge electrodes within.

18. The PDP of claim 17, wherein ones of said first barrier ribs that extend in said first direction and that includes more than one of said front discharge electrodes and more than one of said back discharge electrodes being wider than ones of said first barrier ribs that extend in said first direction and that do not include more than one front discharge electrode and more than one back discharge electrode.

19. The PDP of claim 9, portions of first barrier ribs that are within a single sub-pixel being narrower than portions of said first barrier ribs that are between two different sub-pixels.

* * * * *